US007216460B2

(12) United States Patent
Sourlis

(10) Patent No.: US 7,216,460 B2
(45) Date of Patent: May 15, 2007

(54) DRAINAGE SYSTEM FOR USE IN MASONRY BLOCK CONSTRUCTION

(76) Inventor: Tom Sourlis, 3646 Ridge Rd., Highland, IN (US) 46322

( * ) Notice: Subject to any disclaimer, the term of this patent is extended or adjusted under 35 U.S.C. 154(b) by 387 days.

(21) Appl. No.: 10/393,689

(22) Filed: Mar. 21, 2003

(65) Prior Publication Data

US 2004/0182037 A1 Sep. 23, 2004

(51) Int. Cl.
*E04B 2/00* (2006.01)
*E04B 1/70* (2006.01)

(52) U.S. Cl. ..... 52/169.5; 52/302.3; 52/606

(58) Field of Classification Search ..... 52/606, 52/169.5, 302.1, 302.4, 62
See application file for complete search history.

(56) References Cited

U.S. PATENT DOCUMENTS

| | | | | |
|---|---|---|---|---|
| 835,669 | A | 11/1906 | Eckley | |
| 1,746,816 | A | 2/1930 | Boes | |
| 1,927,881 | A | 9/1933 | Wetmore | |
| 2,061,633 | A | 11/1936 | Muller | |
| 2,657,570 | A | 11/1953 | Moore | |
| 2,934,931 | A | 5/1960 | Johnson | |
| 3,241,272 | A | 3/1966 | Edwards | |
| 3,293,810 | A | 12/1966 | Cox | |
| 3,429,084 | A | 2/1969 | Brewer | |
| 3,668,829 | A | 6/1972 | Nelson | |
| 4,248,926 | A * | 2/1981 | Tajima et al. | 442/90 |
| 4,253,285 | A | 3/1981 | Enright | |
| 4,272,931 | A | 6/1981 | Stanizzo | |
| 4,375,143 | A | 3/1983 | Godlewski | |
| 4,612,742 | A | 9/1986 | Bevilacqua | |
| 4,907,385 | A | 3/1990 | Biodrowski | |
| 4,910,931 | A | 3/1990 | Pardue, Jr. | |
| 5,115,614 | A | 5/1992 | McGrath | |
| 5,120,162 | A | 6/1992 | Parker | |
| 5,230,189 | A | 7/1993 | Sourlis | |
| 5,274,968 | A | 1/1994 | Pardo | |
| 5,343,661 | A | 9/1994 | Sourlis | |
| 5,596,857 | A | 1/1997 | Besche | |
| 5,598,673 | A * | 2/1997 | Atkins | 52/302.1 |
| 5,692,348 | A * | 12/1997 | Ambrosino | 52/169.5 |
| 5,870,864 | A | 2/1999 | Snyder et al. | |
| 5,937,594 | A | 8/1999 | Sourlis | |

(Continued)

OTHER PUBLICATIONS

Ramsey, Architectural Graphic Standards, 6th Ed., John Wiley & Sons, Inc., 1970, p. 312 (3 pages).*

(Continued)

*Primary Examiner*—Tamara L. Graysay

(57) ABSTRACT

A drainage system comprises an elongate flashing member having a width similar to width of CMUs, to be received beneath a course of CMUs, in use. A layer of water permeable material is attached to an upper surface of the flashing member. The water permeable material includes a longitudinal portion extending longitudinally adjacent a rear edge of the flashing member and a plurality of transverse portions extending transversely from the longitudinal portion to a front edge of the flashing member. A plurality of blocks of water permeable material are provided, each being positioned above the layer of water permeable material and extending upwardly into cavities of CMUs, in use. The water permeable material of the layer and the blocks has a porosity sufficient to permit water to pass therethrough but substantially insufficient to permit mortar and debris to pass therethrough so that water in cavities of the CMUs drains through the transverse portions.

36 Claims, 4 Drawing Sheets

U.S. PATENT DOCUMENTS

| | | | | |
|---|---|---|---|---|
| 5,946,870 | A | 9/1999 | Bifano et al. | |
| 6,000,186 | A | 12/1999 | Fielding et al. | |
| 6,023,892 | A | 2/2000 | Sourlis | |
| RE36,676 | E | 5/2000 | Sourlis | |
| 6,112,476 | A * | 9/2000 | Schulenburg | 52/169.5 |
| 6,131,353 | A * | 10/2000 | Egan | 52/408 |
| 6,202,366 | B1 | 3/2001 | Snyder et al. | |
| 6,474,031 | B2 * | 11/2002 | Phillips | 52/302.1 |
| 6,672,016 | B2 * | 1/2004 | Janesky | 52/169.5 |

OTHER PUBLICATIONS

Internet listing from www.mortarnet.com regarding the Mortar Net Block.

* cited by examiner

DRAINAGE SYSTEM FOR USE IN MASONRY BLOCK CONSTRUCTION

FIELD OF THE INVENTION

This invention relates to concrete masonry unit wall construction and, more particularly, to a drainage system therefor.

BACKGROUND OF THE INVENTION

Single wythe masonry walls are constructed using concrete masonry units (CMUs). CMUs are sometimes referred to as cinder blocks. A CMU consists of a hollow rectangular building block having one or more vertical cavities. In single wythe masonry wall construction a foundation is formed, typically of concrete. The wall is formed by laying the CMUs in alternating fashion in multiple courses depending on the height of the wall. Owing to the construction, the vertical cavities of CMUs are aligned to provide a continuous channel from the top of the wall down to the foundation. Mortar is used in joints to join the CMUs.

Cracks in the CMUs can allow water to enter the cavities. Moisture can also condense in the cavities under changing temperatures. Either way, water may collect in the cavities in the CMUs.

The presence of moisture in the cavities is undesirable for a number of reasons. First, the trapped moisture can degrade the structure. Second, the presence of water under freezing temperatures may also cause cracks in the wall when water expands as it freezes. Trapped water in the cavities in the CMUs may cause the CMUs to become discolored, and may even migrate into the dwelling.

To overcome the problems associated with water trapped within the CMU cavities, weep holes are commonly included along the base of the outer side of the CMUs in the lowermost course. The weep holes allow water to pass from the cavity to drain outside the wall structure. A flashing disposed in the cavity directs the collected water toward the weep holes.

During construction of a single wythe masonry wall, excess mortar and other debris can and does fall into the cavities. When the CMUs are stacked during the erection of the wall, for example, mortar droppings are squeezed into the cavities within the CMUs. The excess mortar, as well as other debris, drops to the base of the cavity, and can block weep holes.

One known solution is to construct a CMU drainage course consisting of two wythes separated by a cavity sized to accommodate through wall flashing and blocks of water permeable material. This solution uses different style concrete blocks in the drainage course.

Another known solution, shown in U.S. Pat. No. 6,202,366, uses a collection pan under each CMU cavity to collect water in the cavity. A weep channel on the pan drains the water to the exterior of the wall. This solution requires a collection pan for each vertical cavity.

The present invention is directed to solving one or more of the problems discussed above, in a novel and simple manner.

SUMMARY OF THE INVENTION

In accordance with the invention, there is provided a drainage system for use in concrete masonry unit (CMU) wall construction.

Broadly, the drainage system comprises an elongate flashing member having a width similar to width of CMUs, to be received beneath a course of the CMUs, in use. A layer of water permeable material is attached to an upper surface of the flashing member. The layer of water permeable material includes a longitudinal portion extending longitudinally adjacent a rear edge of the flashing member and a plurality of longitudinally spaced transverse portions extending transversely from the longitudinal portion to a front edge of the flashing member. A plurality of blocks of water permeable material are provided, each being positioned above the layer of water permeable material and extending upwardly into cavities of the CMUs, in use. The water permeable material of the layer and the blocks have a porosity sufficient to permit water to pass therethrough but substantially insufficient to permit mortar and debris to pass therethrough so that water in cavities of the CMUs drains through the transverse portions.

It is a feature of the invention that the layers and the blocks are of the same type of water permeable material. The water permeable material may be a non-water absorbent randomly oriented fibrous material.

It is a feature of the invention that the blocks may be pyramidal or triangular.

It is another feature of the invention that the layer is in the range of ⅛ to ½ inch thick. Advantageously, the layer is about ¼ inch thick.

It is another feature of the invention that the transverse portions are spaced in the range of two to eight inches apart. The transverse portions may be about one inch across.

It is another feature of the invention to provide an elongate bar underneath the rear edge of the flashing member to channel water through the longitudinal portion to the transverse portions. A pair of transverse bars may also be provided underneath opposite longitudinal ends of the flashing member to channel water toward the front edge.

It is a further feature of the invention that the blocks comprise perforated tubes.

It is yet another feature of the invention that the blocks comprise rolls of fibrous mesh.

It is still another feature of the invention that the blocks are in contact with the layer of water permeable material.

There is disclosed in accordance with another aspect of the invention a drainage system for use in single wythe masonry wall construction formed by courses of CMUs each having vertical cavities. The drainage system comprises an elongate flashing member having a width similar to width of the CMUs, to be received beneath a course of CMUs, in use. An elongate bar is underneath a rear edge of the flashing member to define a dam at an interior side of the single wythe masonry wall. A layer of water permeable material is attached to an upper surface of the flashing member. The water permeable material includes an elongate longitudinal portion extending longitudinally outwardly of the dam and a plurality of transverse portions extending transversely from the longitudinal portion to a front edge of the flashing member. A plurality of blocks of water permeable material are each supported on the layer of water permeable material and extend upwardly into cavities of the CMUs, in use. The water permeable material of the layer and the blocks has a porosity sufficient to permit water to pass therethrough but substantially insufficient to permit mortar and debris to pass therethrough so that water in cavities of CMUs drains through the transverse portions.

Further features and advantages of the invention will be readily apparent from the specification and from the drawings.

DETAILED DESCRIPTION OF THE INVENTION

Figure 1:
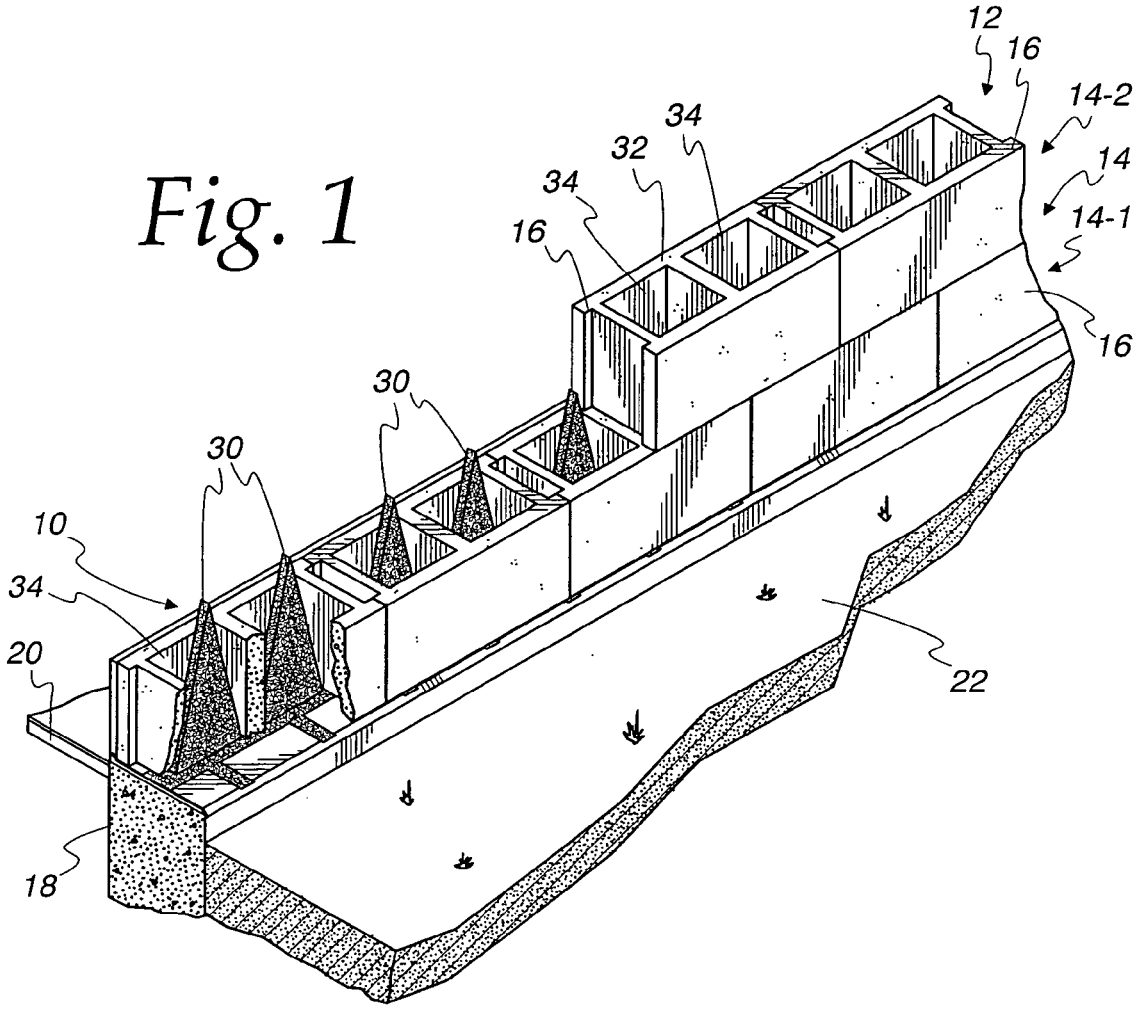
FIG. 1 is an exterior perspective view of a drainage system in accordance with the invention used in a single wythe masonry wall formed by courses of concrete masonry units (CMUs)

Referring to FIG. 1, a drainage system 10 is illustrated in connection with a concrete masonry unit (CMU) wall construction. In the illustrated embodiment of the invention, the drainage system 10 is used in a single wythe masonry wall construction 12 formed by courses 14 of CMUs 16. The wall construction 12 is used on a building structure including a foundation wall 18 with an interior floor 20 inside the foundation wall 18 and exterior grade 22 outside the foundation wall 18. In the illustrated embodiment of the invention, the foundation wall 18 comprises a concrete wall. The foundation wall could be of block construction, as will be apparent to those skilled in the art.

Figure 5:
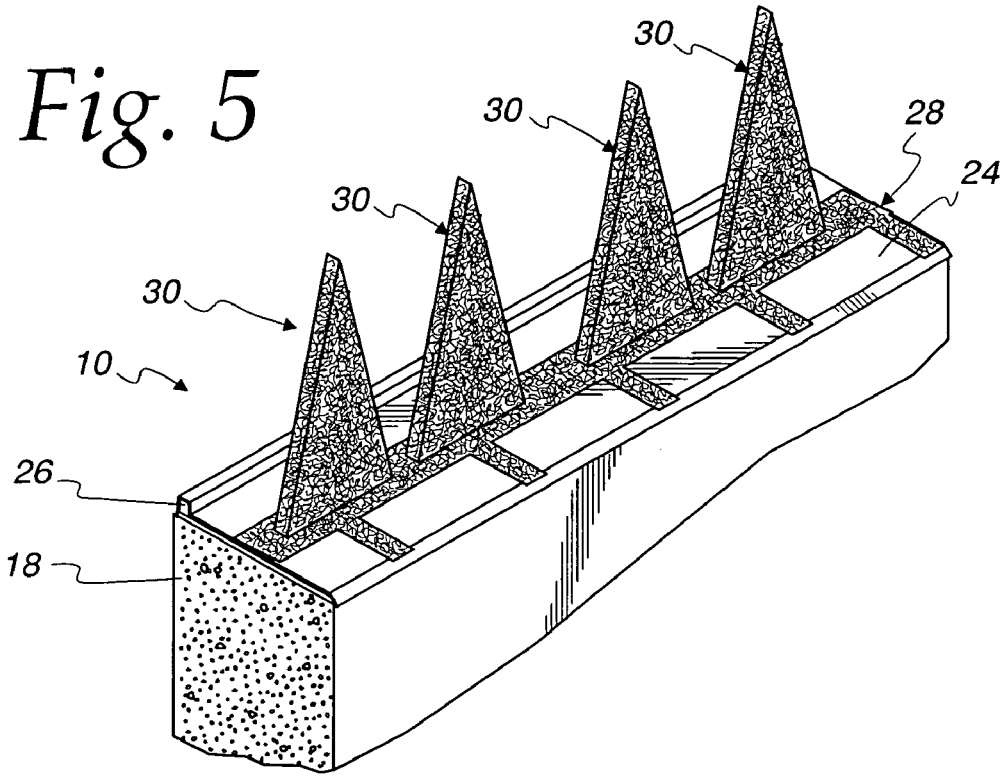
FIG. 5 is an exterior perspective view illustrating the drainage system in accordance with the invention mounted on a foundation.

Referring also to FIGS. 1 and 5, the drainage system 10 comprises a flashing member 24, an elongate bar 26, a layer 28 of water permeable material and a plurality of blocks 30 of water permeable material.

CMUs 16 are typically about 16" long wide and come in nominal widths of eight, ten and twelve inches. The CMU 16 comprises a concrete block 32 having a pair of vertically extending cavities 34 therethrough. In conventional single wythe masonry wall construction, a first course 14-1 of CMUs 16 is secured to the foundation wall 18 with a layer of mortar. Mortar is also provided between adjacent CMUs 16. A layer of mortar is then placed upon the first course 14-1 and the second course 14-2 is laid on the first course 14-1. Again, mortar is provided between each CMU 16. The CMUs 16 in each course are typically offset from one another as illustrated in FIG. 1. As a result, the vertical cavities 34 in any one course 14 are aligned with the vertical cavities 34 in other courses to provide a continuous channel from the top of the wall down to the foundation wall, as is well known.

Figure 2:
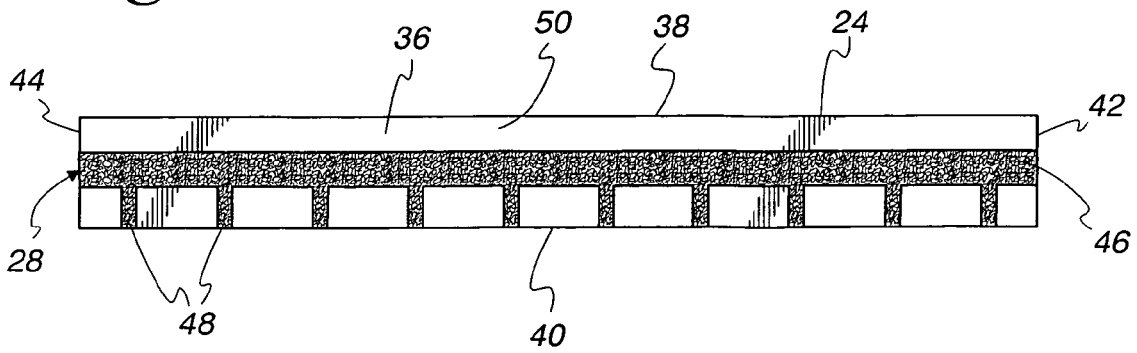
FIG. 2 is a plan view of a flashing member with a layer of water permeable material in accordance with the invention.

Referring to FIG. 2, the flashing member 24 comprises an elongate body 36 of flashing material. The body may be formed of plastic or sheet metal or the like. In the illustrated embodiment of the invention, the flashing member 24 comprises a peel and stick material. As such, an adhesive layer is provided on an underside of the body 36. The body 36 is defined by an inner or rear edge 38, an outer or front edge 40 and opposite longitudinal ends 42 and 44. Width of the body 36 is similar to width of the CMUs. The body 36 has a length sufficient to extend at least across a single cavity 34 or advantageously to extend the entire length of the foundation wall 18.

The layer 28 of water permeable material includes an elongate rectangular longitudinal portion 46 and a plurality of longitudinally spaced shorter, rectangular transverse channel portions 48 extending outwardly therefrom. As used herein, the relative term inner refers to the inner side of the foundation wall, i.e. the rear edge 38 of the flashing member 24, and outer refers to the outer side of the foundation wall, or the front edge 40 of the flashing member 24.

The layer 28 is adhered to a top surface 50 of the flashing member 24, such as by using a suitable adhesive. The longitudinal portion 46 is disposed outwardly adjacent the rear edge 38 at least one inch frontwardly of the rear edge 38. The transverse channel portions 48 extend transversely from the longitudinal portion 46 to the front edge 40 of the flashing member 24. The transverse channel portions 48 are approximately one inch across and are spaced apart in the range of two inches to eight inches, as necessary or desired. The layer 28 has a thickness in the range of about ⅛ inch to ½ inch with ¼ inch being typical. The longitudinal portion 46 serves to interconnect the transverse channel portions 48. In accordance with the invention, the layer 28 could be provided without the longitudinal portion 46 and use only individual transverse channel portions 48 extending to the front edge 40

In the illustrated embodiment of the invention, the water permeable material used in the layer 28 functions to permit water to pass therethrough and to substantially prevent mortar and other debris from passing therethrough. The material is preferably a non-absorbent water-permeable, fibrous mesh material formed with circuitous (non-linear) pathways. The material is preferably a massive random filament-type plastic fibers with a density which is sufficient to catch and support mortar and other debris thereon without significant collapse, but allow water to pass freely therethrough. A preferred embodiment of the material is a polyethylene or polyester fibrous mesh such as ENKAD-RAIN 9120 normally manufactured by Akzo Industries. The layer 28 may be provided as one piece or the transverse channel portions 48 may be provided separate from the longitudinal portion 46, as desired. The layer 28 may also be formed of a perforated tubular or cylindrical material.

Alternatively, the water permeable material could be made by a partial-fusion process which fuses closed-cell propylene or polyethylene beads together at the tangents of the beads. In this case water would flow between the beads in noncontacting areas.

Figure 3:
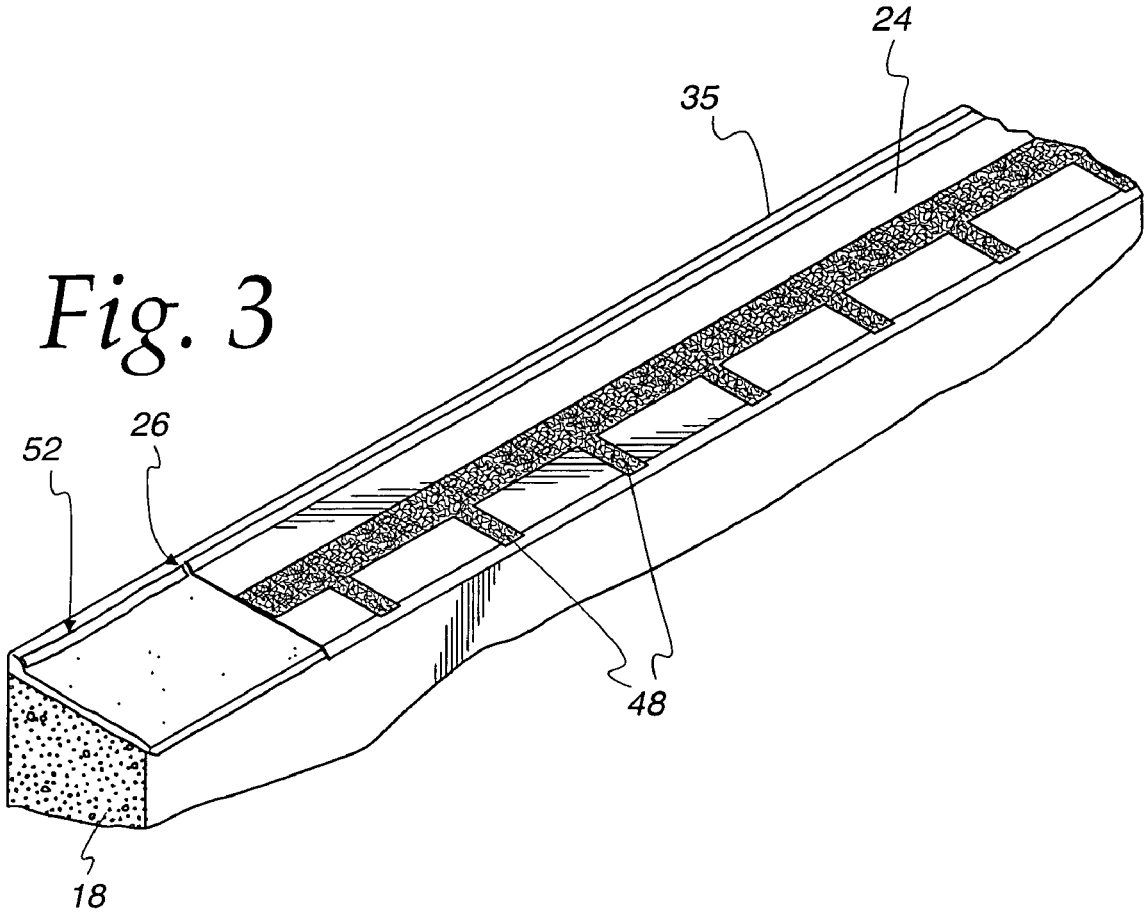
FIG. 3 is an exterior perspective view of an elongate bar and the flashing material of FIG. 2 mounted to a wall foundation.
Figure 4:
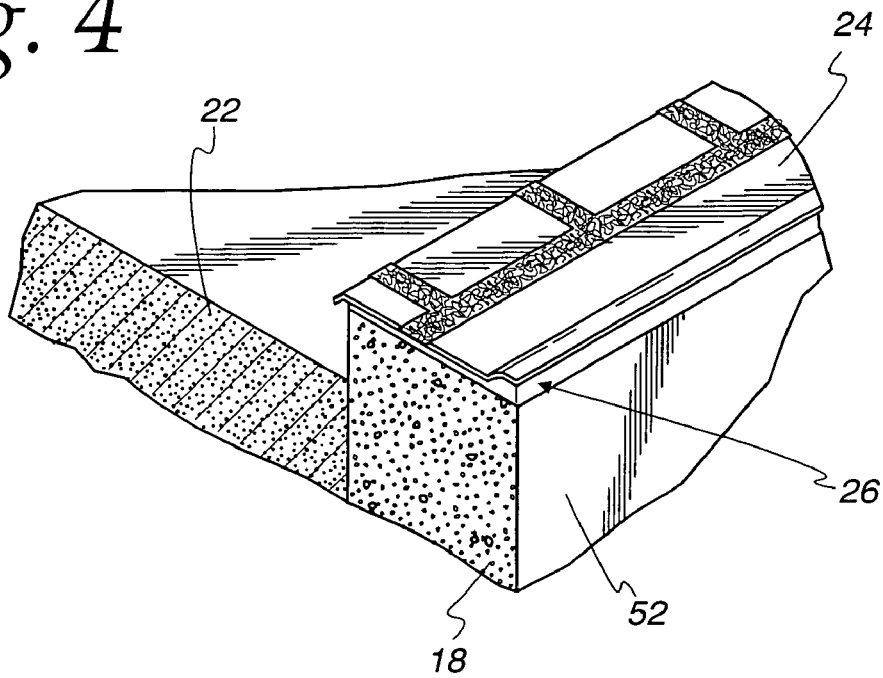
FIG. 4 is an interior perspective view of the elongate bar and the flashing material of FIG. 2 mounted to a wall foundation.

Referring also to FIG. 3, the elongate bar 26 consists of ¼ inch high bar stock of plastic placed along the foundation wall 18 near an interior side 52. The flashing member 24, a portion of which is shown in FIG. 3, is adhered to the foundation wall 18 with the rear edge 38 raised and overlying the elongate bar 26 to define a dam at the interior side 52 of a single wythe masonry wall. Due to the self adhering nature of the underside of the flashing member 24, the flashing member 24 adheres to the top of the foundation 18 and to the bar 26.

In the illustrated embodiment to the invention, the elongate bar 26 is used in combination with the flashing member 24 to define a dam, as described. Alternatively, other devices could be used to raise the rear edge to define a dam. Additionally, the foundation wall could be "L" shaped as by having a continuous ridge proximate its rear edge. The flashing member 24 can then be formed or is placed on the foundation to adapt to the foundation shape and thus similarly provide a dam at the interior side of the masonry wall.

Thereafter, the first course 14-1 is constructed in the conventional manner applying mortar between the first course 14-1 and the flashing member 24. As such, the first course 14-1 is constructed on top of the flashing member 24 and layer 28. At least some of the transverse channel portions 48 are generally centered in the cavities 34 and serve to create weep holes within the mortar joint. If mesh material is used, the transverse channel portions 48 may be provided with suitable reinforcement such as solid plastic rods or the like to accommodate the load of the CMUs 16.

Figure 7:
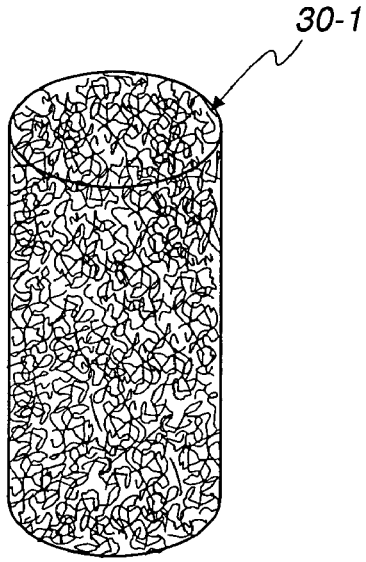
FIG. 7 is a perspective view of a block of water permeable material according to an alternative embodiment of the invention.
Figure 8:
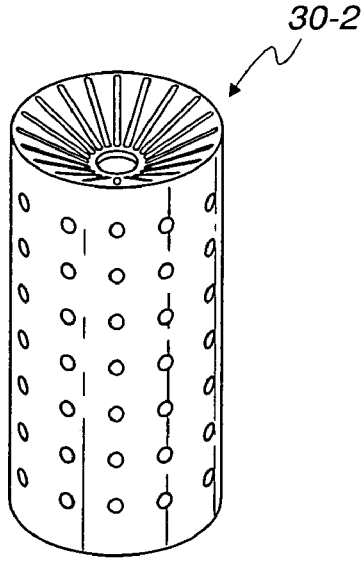
FIG. 8 is a perspective view of a block of water permeable material according to a further alternative embodiment of the invention.
Figure 9:
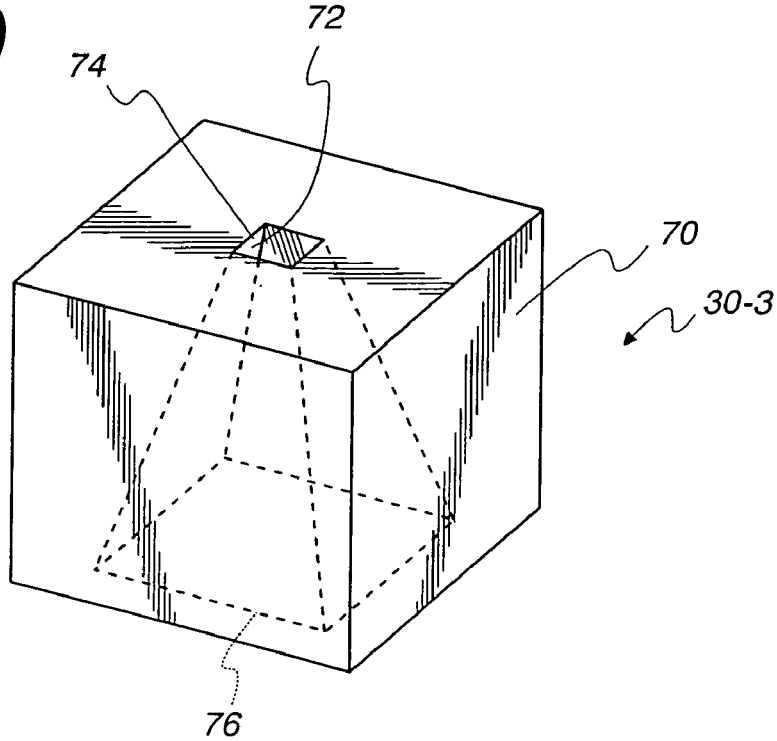
FIG. 9 is a perspective view of a block of water permeable material according to yet another alternative embodiment to the invention.

Referring to FIG. 5, the blocks 30 comprise wedge blocks and are preferably triangular or pyramid shaped and are of a water permeable material. The wedge blocks 30 could be of other shapes, such as conical or trapezoidal, or the like. The water permeable material may be the same material that is described above relative to the layer 28. In the illustrated embodiment of the invention, the blocks 30 are in the range of eight inches to sixteen inches tall and about two inches thick. The lower end has a width corresponding generally to the width of the CMU cavities 34. Subsequent to laying of the first course 14-1, the blocks 30 are placed in the cavities 34 and are positioned above the layer 28. This can be done by the blocks 30 being wedged in the cavities 34 or by the blocks 30 directly resting on the layer 28. Alternatively, the wedges 30 could be attached to the flashing member 24 or to the layer 28. As an alternative to the triangular wedge fiber mesh design, the blocks could consist of rolls 30-1, see FIG. 7, of fiber mesh material, as above. Also, the blocks could consist of perforated tubes 30-2, see FIG. 8, of plastic or the like. Other shape tubes could also be used. Still a further alternative block 30-3 is illustrated in FIG. 9. The block 30-3 comprises a parallelepiped head piece 70 of fiber mesh material, as above. The size of the piece 70 corresponds to the size of the block cavities 34 to be received therein. The piece 70 includes a pyramid shaped hollowed area 72 extending from a relatively small square shaped top opening 74 to a relatively large square shaped bottom opening 76. As is apparent, other hollowed out shapes could be used, such as square or rectangular, or the like, as will be apparent to those skilled in the art. As above, the block 30-3 would be positioned above the flashing member 24.

In accordance with the invention, water in the CMU cavities 34 is channeled downwardly through the triangular wedges 30 and subsequently to the layer 28. Within the layer 28, the water is channeled to the transverse channel portions 48, either directly or through the longitudinal portion 46, where the water is channeled to the exterior of the foundation 18.

Figure 6:
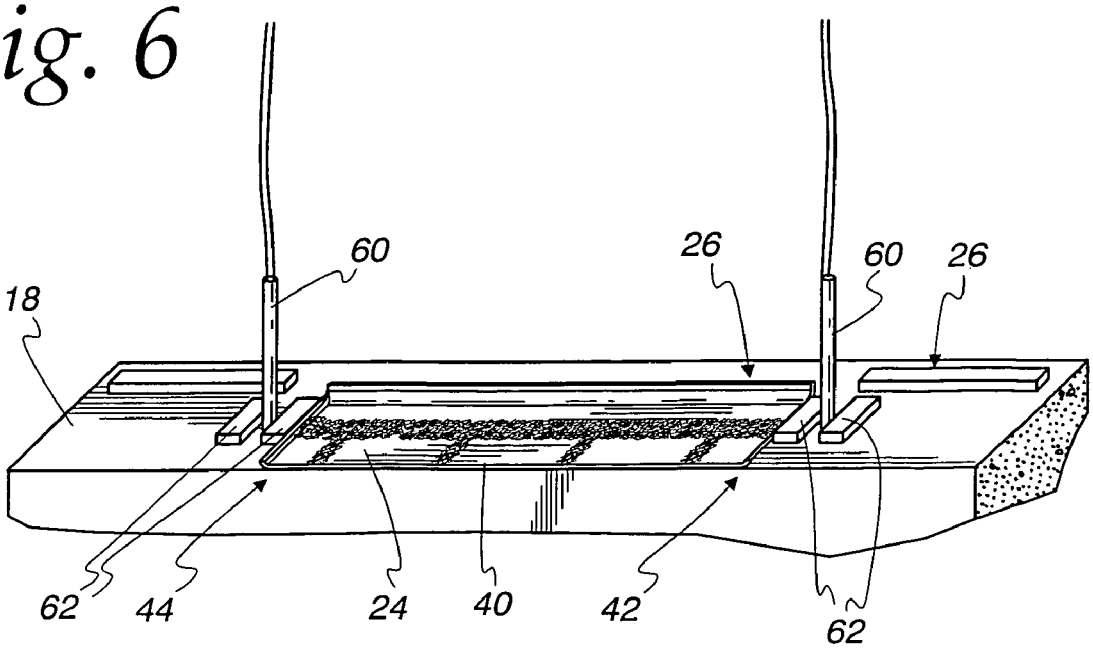
FIG. 6 is a perspective view of an alternative embodiment of the drainage system in accordance with the invention used in a reinforced single wythe masonry wall construction.

Referring to FIG. 6, rebar 60 may extend vertically from the foundation wall 18. For these applications ¼ inch plates 62 are positioned either side of each rebar 60 outwardly of the elongate bar 26. The flashing member 24 is cut to fit between the rebars 26 and the opposite ends 42 and 44 are raised up by the plates 62 to dam water that is then channeled out the front edge 40 of the flashing member 24 via the strips 48, as above.

Thus, in accordance with the invention, there is provided a single sheet-like product which serves as a flashing and a continuous drainage system that allows water to have an exit along substantially the entire length of the product. In so doing, the possibility of ponding is eliminated and ventilation of the cavities 34 is increased. The installation of the combination flashing and mortar and debris collection devices and system of the present invention require no adhesives or attachments other than that normally associated with conventional flashing installations.

I claim:

1. A drainage system for use in concrete masonry unit (CMU) wall construction, comprising:

an elongate flashing member adapted to be received beneath a course of CMUs, in use;

a layer of water permeable material attached to an upper surface of the flashing member, the layer of water permeable material including a longitudinal portion extending longitudinally adjacent and spaced from a rear edge of the flashing member and a plurality of transverse portions extending transversely from the longitudinal portion to a front edge of the flashing member; and a plurality of separate blocks of water permeable material, each block being positioned above the layer of water permeable material and adapted to extend upwardly into a cavity of the CMUs, in use, the water permeable material of the layer and the blocks having a porosity sufficient to permit water to pass therethrough but substantially insufficient to permit mortar and debris to pass therethrough so that water in cavities of CMUs drains through the transverse portions.

2. The drainage system of claim 1 wherein the layer and the blocks are of the same type of water permeable material.

3. The drainage system of claim 2 wherein the water permeable material is a non-water absorbent randomly oriented fibrous material.

4. The drainage system of claim 1 wherein the blocks include a hollow interior pyramid shape.

5. The drainage system of claim 1 wherein the blocks are triangular shaped.

6. The drainage system of claim 1 wherein the layer is in the range of ⅛ to ½ inch thick.

7. The drainage system of claim 1 wherein the layer is about ¼ inch thick.

8. The drainage system of claim 1 wherein the transverse portions are spaced in the range of two to eight inches apart.

9. The drainage system of claim 1 wherein the transverse portions are about one inch across.

10. The drainage system of claim 1 further comprising an elongate bar underneath the rear edge of the flashing member to channel water through the longitudinal portion to the transverse portions.

11. The drainage system of claim 10 further comprising a pair of transverse bars underneath opposite longitudinal ends of the flashing member to channel water toward the front edge.

12. The drainage system of claim 1 wherein the blocks comprise perforated tubes.

13. The drainage system of claim 1 wherein the blocks comprise rolls of fibrous mesh.

14. The drainage system of claim 1 wherein the blocks are in contact with the layer of water permeable material.

15. A drainage system for use in single wythe masonry wall construction formed by courses of concrete masonry units (CMUs) each having vertical cavities, comprising:

an elongate flashing member adapted to be received beneath a course of CMUs, in use;

a rear edge of the flashing member being raised to define a dam at an interior side of the single wythe masonry wall;

a layer of water permeable material attached to an upper surface of the flashing member, the water permeable material including a longitudinal portion extending longitudinally adjacent and spaced from the dam and a plurality of transverse portions extending transversely from the longitudinal portion to a front edge of the flashing member; and a plurality of separate blocks of water permeable material, each block being positioned on the layer of water permeable material and adapted to extend upwardly into a cavity of the CMUs, in use, the water permeable material of the layer and the blocks having a porosity sufficient to permit water to pass therethrough but substantially insufficient to permit mortar and debris to pass therethrough so that water in cavities of CMUs drains through the transverse portions.

16. The drainage system of claim 15 wherein the layer and the blocks are of the same type of water permeable material.

17. The drainage system of claim 16 wherein the water permeable material is a non-water absorbent randomly oriented fibrous material.

18. The drainage system of claim 15 wherein the blocks include a hollow interior pyramid shape.

19. The drainage system of claim 15 wherein the blocks are triangular shaped.

20. The drainage system of claim 15 wherein the layer is in the range of ⅛ to ½ inch thick.

21. The drainage system of claim 15 wherein the layer is about ¼ inch thick.

22. The drainage system of claim 15 wherein the transverse portions are spaced in the range of two to eight inches apart.

23. The drainage system pf of claim 15 wherein the transverse portions are about one inch across.

24. The drainage system of claim 15 wherein the flashing comprises self adhering flashing.

25. The drainage system of claim 15 further comprising raised longitudinal ends of the flashing member to channel water toward the front edge.

26. The drainage system of claim 15 wherein the blocks comprise perforated tubes.

27. The drainage system of claim 15 wherein the blocks comprise rolls of fibrous mesh.

28. The drainage system of claim 15 wherein the blocks are in contact with the layer of water permeable material.

29. A drainage system for use in concrete masonry unit (CMU) wall construction, comprising:

a flashing member adapted to be received beneath the CMU, in use;

a transverse channel of water permeable material on a top surface of the flashing member spaced from a rear edge of the flashing member and extending to a front edge of the flashing member; and a wedge of water permeable material supported above the transverse channel and adapted to extend upwardly into a cavity of the CMU, in use, the water permeable material of the channel and the wedge having a porosity sufficient to permit water to pass therethrough but substantially insufficient to permit mortar and debris to pass therethrough so that water in a cavity of the CMU drains through the channel.

30. The drainage system of claim 29 wherein the channel and the wedge are of the same type of water permeable material.

31. The drainage system of claim 30 wherein the water permeable material is a non-water absorbent randomly oriented fibrous material.

32. The drainage system of claim 29 wherein the channel is formed of a perforated plastic material.

33. The drainage system of claim 29 wherein the wedge is triangular shaped.

34. The drainage system of claim 29 comprising a plurality of transverse channels spaced in the range of two to eight inches apart.

35. The drainage system of claim 29 wherein a rear edge of the flashing member is raised to channel water through the channel.

36. The drainage system of claim 35 wherein lateral edges of the flashing member are raised to channel water through the channel.

* * * * *